US005577692A

United States Patent [19]

Rollins

[11] Patent Number: 5,577,692

[45] Date of Patent: Nov. 26, 1996

[54] BABY BOTTLE HOLDER

[76] Inventor: Arthur D. Rollins, 940 Gates Ave., Apt. 6E, Brooklyn, N.Y. 11221

[21] Appl. No.: 533,327

[22] Filed: Sep. 25, 1995

[51] Int. Cl.[6] ..... A47D 15/00

[52] U.S. Cl. ..... 248/106; 248/105; 224/926

[58] Field of Search ..... 248/106, 105, 248/103, 104, 102, 311.2, 276.1, 581, 599, 602, 624, 132; 224/926

[56] References Cited

U.S. PATENT DOCUMENTS

| | | | |
|---|---|---|---|
| 2,063,554 | 12/1936 | Meyerson | 248/106 |
| 2,092,526 | 9/1937 | Aprile | 248/106 |
| 2,386,042 | 10/1945 | Elezeer | 248/106 |
| 2,912,200 | 11/1959 | Reinhorn | 248/106 |
| 2,931,608 | 4/1960 | Farah | 248/106 |
| 3,184,193 | 5/1965 | Melvin | 248/106 |
| 4,093,165 | 6/1978 | Sussman | 248/106 |
| 4,583,707 | 4/1986 | Anderson | 248/311.2 |
| 5,192,041 | 3/1993 | Bryant | 248/104 |

*Primary Examiner*—Ramon O. Ramirez
*Assistant Examiner*—Willie Berry, Jr.
*Attorney, Agent, or Firm*—Terry M. Gernstein

[57] ABSTRACT

A baby bottle holder includes an inner cup connected to an outer cup by a spring and the outer cup connected to a support by a flexible element whereby a baby bottle held in the inner cup has a plurality of degrees of freedom with respect to a support and with respect to the outer cup. A slide panel is located inside the outer cup and the rim of the inner cup slides on that slide panel. Air vents are included as is an accessory attaching anchor.

8 Claims, 4 Drawing Sheets

BABY BOTTLE HOLDER

TECHNICAL FIELD OF THE INVENTION

The present invention relates to the general art of baby bottle holders, and to the particular field of baby bottle holders that hold a baby's bottle in a desired position while the baby is using the bottle.

BACKGROUND OF THE INVENTION

The art has long recognized a need for holding a baby's bottle while that baby uses the bottle. Therefore, the art includes several devices that mount on a support, such as an infant's seat, or the like, and which have a means for holding the baby bottle in position for the infant to use the bottle. These devices are intended to free the baby's care provider to do other tasks while the baby takes its bottle.

While helpful, the devices heretofore known in the art still have several drawbacks and disadvantages. The principal drawback with the known devices is that they do not mount the bottle in an extremely secure manner while still permitting movement of the bottle separate from the elements which attach the bottle to the support. This drawback makes either the mounting too loose or the bottle difficult to move for the infant. Still further, the known devices do not provide as much freedom of movement of the baby bottle as may be required to fully meet the needs of the infant.

Therefore, there is a need for a baby bottle holder which can be securely, yet movably mounted on a support and which has sufficient freedom of movement to accommodate a baby's needs both as to positioning of the bottle and with respect to the ease of movement.

OBJECTS OF THE INVENTION

It is a main object of the present invention to provide a baby bottle holder which can be securely mounted on a support, yet which also provides a great deal of freedom of movement for the baby.

It is another object of the present invention to provide a baby bottle holder which can be securely mounted on a support,and which can adapt a multiplicity of orientations both with respect to the support and also with respect to the means anchoring the bottle holder to the support.

It is another object of the present invention to provide a baby bottle holder which can be securely mounted on a car seat, yet which will be very stable and yet can be moved to numerous positions and orientations with respect to the car seat as well as with respect to the infant.

SUMMARY OF THE INVENTION

These, and other, objects are achieved by a baby bottle holder which has an outer cup movably attached to a support, such as a car seat, by a flexible anchor means and to which an inner cup is movably attached by a spring. A baby's bottle is snugly and frictionally received in the inner cup and can be moved with respect to the outer cup, which, in turn, can be moved with respect to the support whereby a multiplicity of positions and orientations of the baby's bottle can be easily selected by the baby. A slide means is interposed between the side wall of the inner cup and the side wall of the outer cup to ensure smooth and reliable movement of the inner cup with respect to the outer cup. The spring connection of the inner cup to the outer cup ensures reliable and accurate movement of the inner cup with respect to the outer cup whereby extra degrees of freedom are provided for the device.

BRIEF DESCRIPTION OF THE DRAWING FIGURES

DETAILED DESCRIPTION OF THE PREFERRED EMBODIMENT OF THE INVENTION

Figure 1:
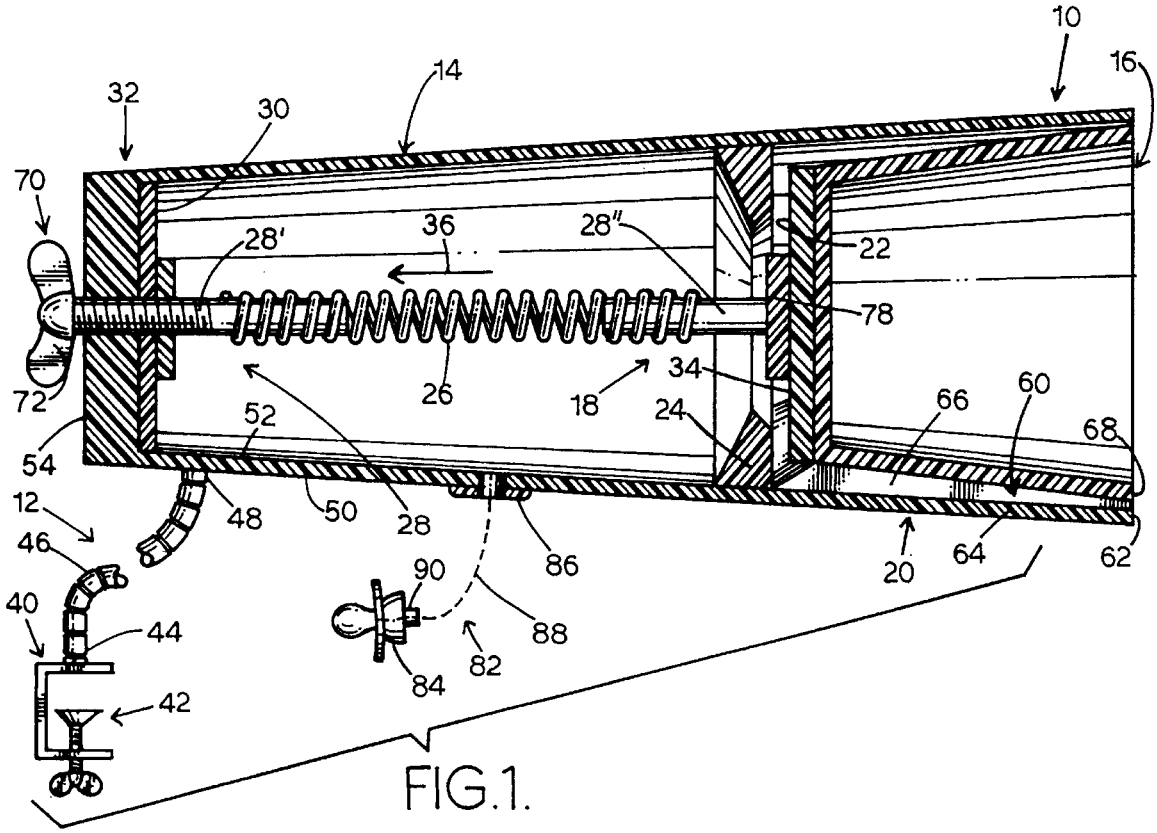
FIG. 1 shows the baby bottle holder embodying the present invention with an anchor means for attaching the outer cup to a support, such as a car seat.
Figure 3:
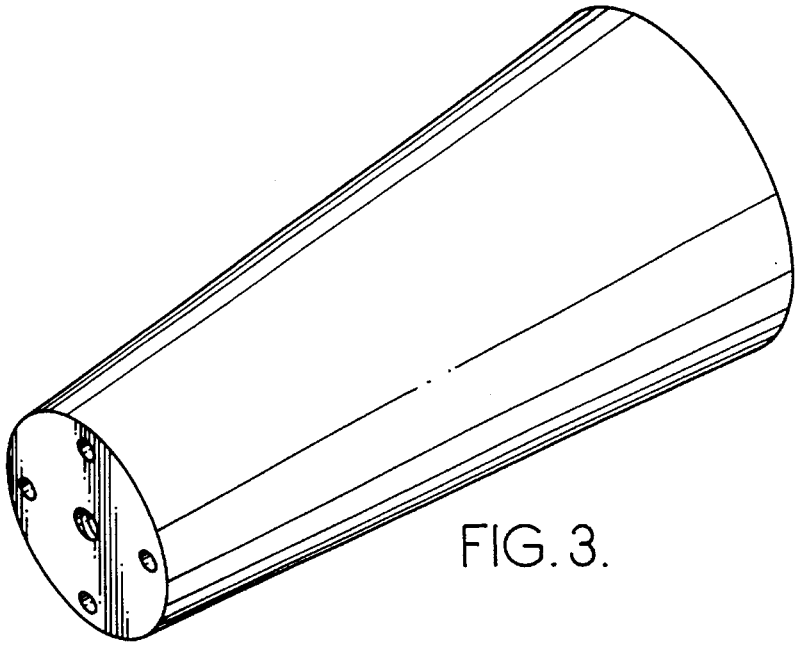
FIG. 3 shows the inner cup.
Figure 2:
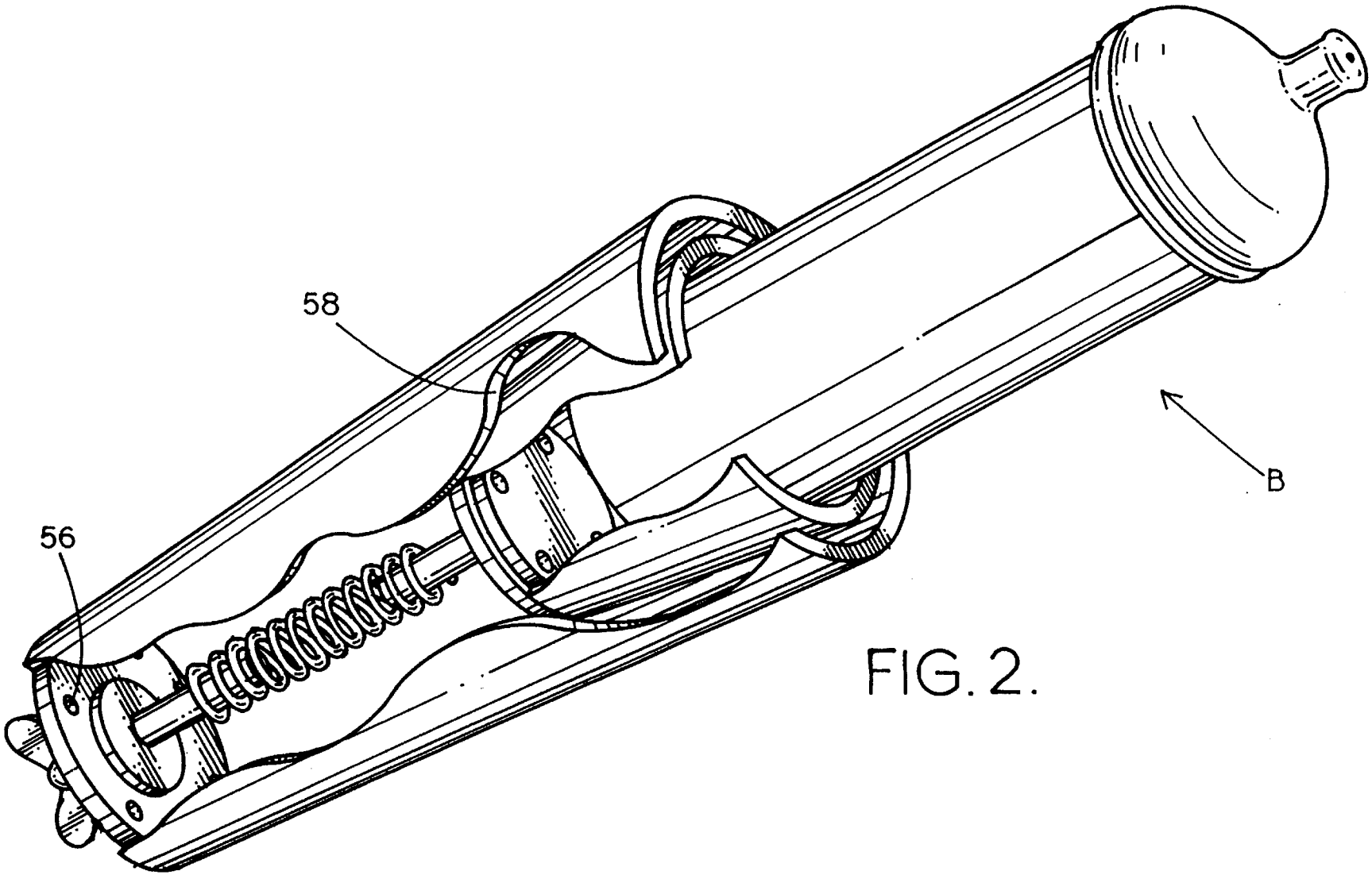
FIG. 2 shows the inner and outer cups of the baby bottle holder with a baby bottle snugly received in the inner cup.

Shown in FIGS. 1 and 2 is a baby bottle holder 10 embodying the present invention. Baby bottle holder 10 includes, broadly, an anchor means 12 anchoring the bottle holder to a support, such as a car seat, a crib, a baby carriage, or the like, an outer cup 14 attached to the anchor means, an inner cup 16 movably attached to the outer cup by an anchor bolt means 18 and which slides on a slide panel 20 between a first position with bottom 22 abutting stop means 24 and a second position spaced from that first position. A spring 26 is mounted on a bolt 28 and has one end thereof attached to the inner surface 30 of bottom 32 of the outer cup and another end attached to the outer surface 34 of the bottom 22 to bias the inner cup in direction 36 towards the bottom 32 and towards abutting contact with stop means 24. A baby bottle B (see FIG. 2) is snugly received in inner cup 16.

Due to the spring connection between inner cup 16 and outer cup 14, the inner cup can move relative to the outer cup. Due to the flexible connection effected by anchor means 12, the outer cup can move relative to a support. Therefore, bottle B can move with respect to either or both the support and/or the outer cup thereby producing a multitude of degrees of freedom for the baby bottle.

More specifically, anchor means 12 includes a clamp 40 that is attachable to a support and includes a screw operated jaw 42. Clamp 40 is connected to a proximal end 44 of a flexible element 46 which can be flexed in a plurality of directions and which has a distal end 48 attached to outer surface 50 of sidewall 52 of outer cup 14. An alternative form of the holder has proximal end 48 attached to outer surface 54 of bottom 32.

Figure 4:
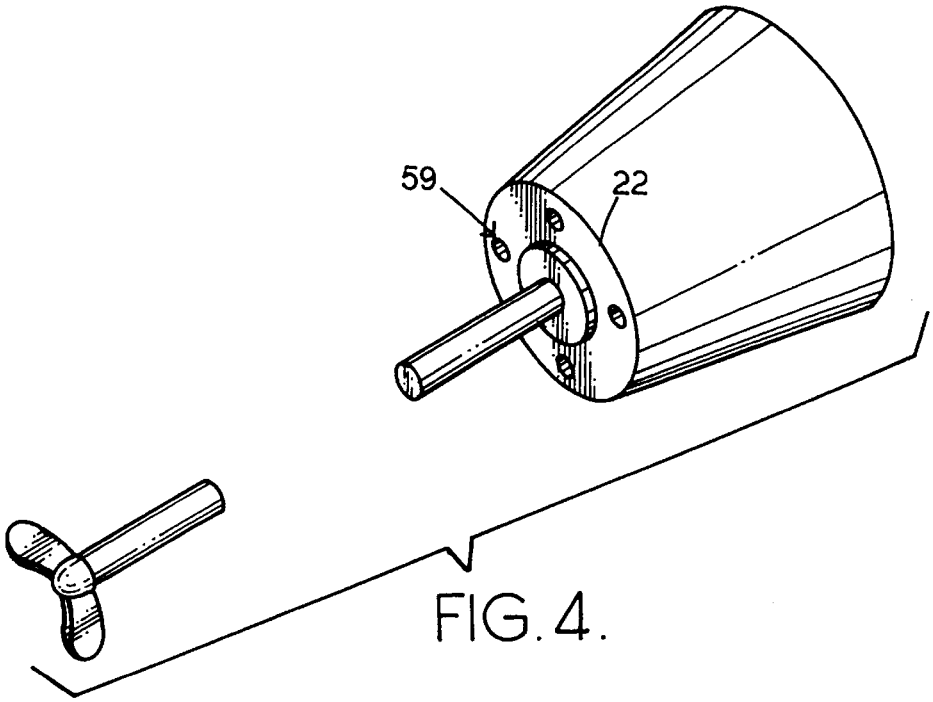
FIG. 4 shows the inner cup with an anchor bolt for attaching the inner cup to the outer cup.

Outer cup 14 further includes air vents, such as holes 56 defined through bottom 32, or vents, such as elongated slot and/or vent 58, defined through sidewall 52. As shown in FIG. 4, air holes 59 can be included in the bottom 22 of inner cup as well. A slide means 60 is attached to the inner surface of sidewall 52 adjacent to top rim 62 of the sidewall 52. Means 60 extends from adjacent to rim 62 to adjacent stop means 24 and includes sides, such as side 64, and concave surface 66, which is curved to snugly receive inner cup 16 in sliding contact. As shown, top rim 68 of inner cup 16 abuts sliding surface 66 so the surface 66 is curved in a manner and in a direction to accommodate the sliding contact between these two elements.

Stop means 24 includes a shoulder mounted on inner surface 52 and which extends radially inward of the outer cup to a radius that is less than the radius of the inner cup bottom 22 whereby that inner cup bottom will abut the stop means. Anchor bolt means 18 includes a bolt 28' attached to bottom 30 and bolt 28" attached to bottom 22. The bolts 28' and 28" are spring mounts for spring 26 and are connected to the spring. As will be discussed below, bolt 28' is movable with respect to bottom 32 along the longitudinal direction of the outer cup. Spring 26 flexibly connects the inner cup to the outer cup and biases the inner cup in direction 36.

An adjustment means 70 includes a threaded fastener element 72 threadably connected to bottom 32 and connected to bolt 28' to move that bolt when element 72 is operated. Movement of the element 72 moves bolt 28' towards or away from stop means 24. Thus, the amount of spring force exerted on the inner cup by spring 26 can be adjusted by adjusting element 72 to stretch Spring 26 or relax spring 26. Since the inner cup is coupled to the outer cup by spring 26, sliding means 60 is useful in maintaining proper alignment between the inner cup with respect to the outer cup. Either the top rim of inner cup and/or the sidewall of the inner cup slidably engages the slide surface.

Figure 5:
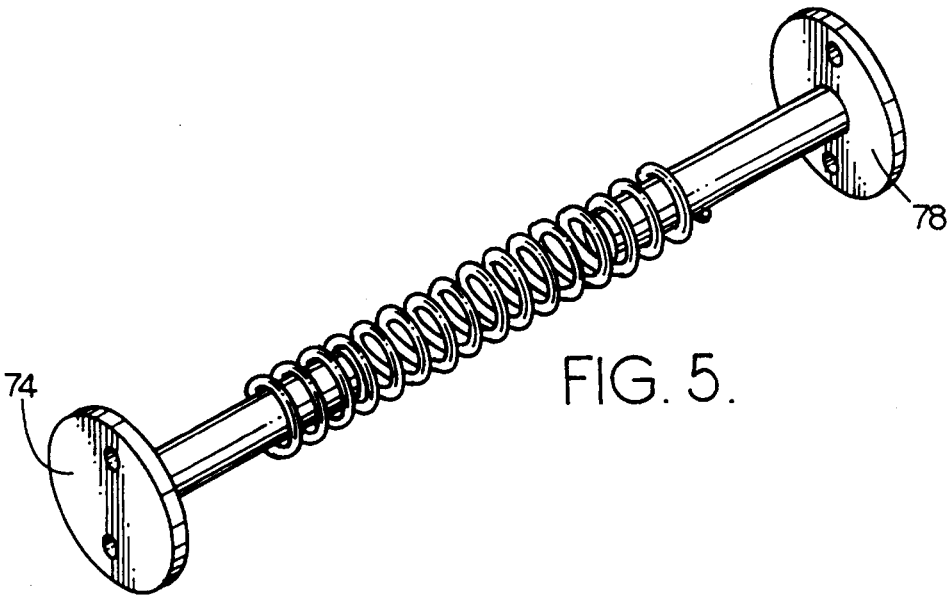
FIG. 5 shows the means for attaching the inner cup to the outer cup.
Figure 6:
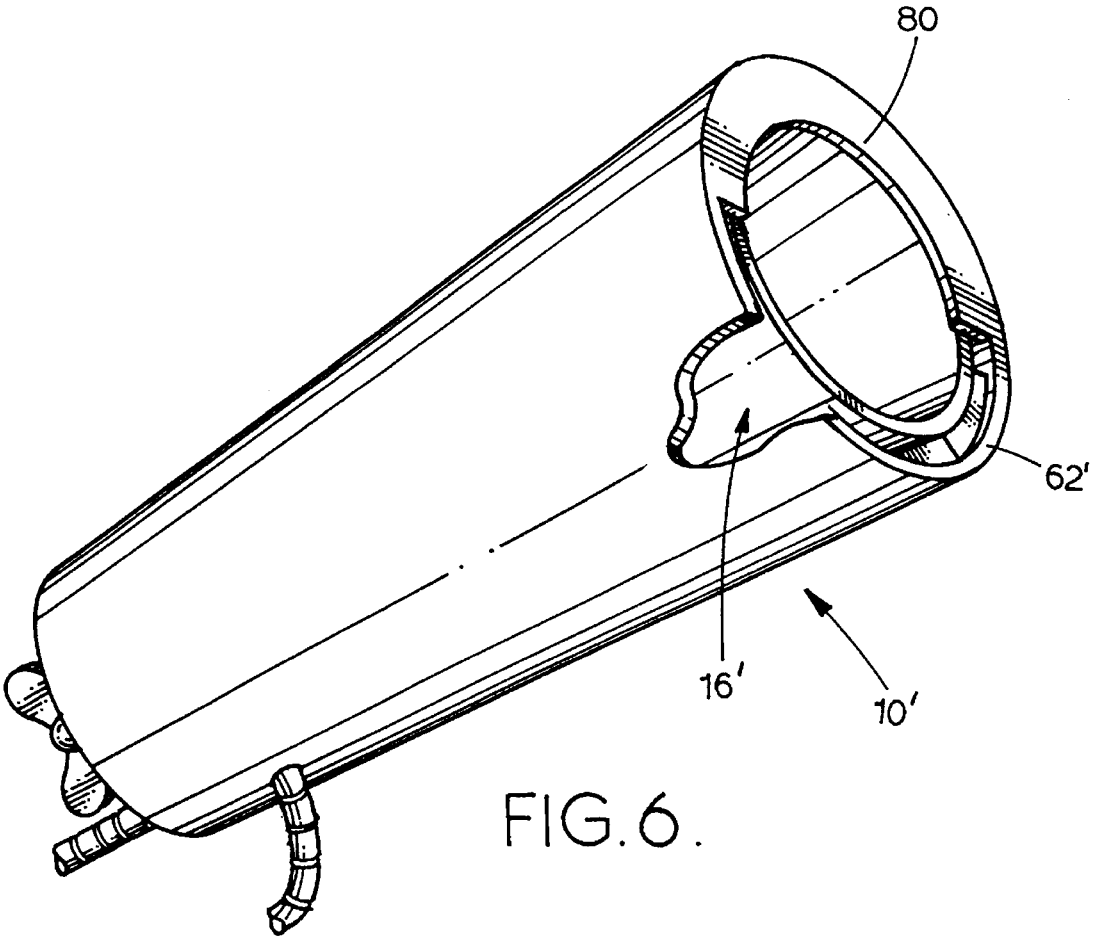
FIG. 6 shows the baby bottle holder showing an alternative form of the device.

As shown in FIGS. 5 and 6, bolt 28' is attached to a plate 74 which is attached to bottom 32 by fasteners, such as fastener 76. A plate 78 can also attach bolt 28" to bottom 22.

An alternative form of the bottle holder is shown in FIG. 6 as bottle holder 10'. Bottle holder 10' is similar to bottle holder 10 except that stop means 24 is omitted in holder 10' and is replaced by a rim 80 on inner cup 16' which abuts rim 62' of outer cup 14 when the inner cup is in the first position discussed above and shown in FIG. 1. Flexible element 12 is connected to the sidewall of the outer cup in holder 10'. Still further, an accessory holder 82 for holding an accessory, such as a pacifier 84, or the like, can be attached to the outer surface of the outer cup. Accessory holder 82 includes a mount 86 on the outer cup, a tether 88, and means 90 for releasably holding the accessory on the tether.

As can be understood from the foregoing, a baby bottle B is frictionally held in inner cup 16. Inner cup 16 is held on outer cup 14 by spring means and its movement with respect to the outer cup is controlled by a slide means since the spring may otherwise permit the inner cup to move in an undesired manner with respect to the outer cup. The outer cup is connected to a support by a flexible element whereby the baby bottle can be moved with respect to both the support and the outer cup. This permits the holder to be securely mounted on a support, yet will permit a baby to move the bottle as desired.

It is understood that while certain forms of the present invention have been illustrated and described herein, it is not to be limited to the specific forms or arrangements of parts described and shown.

I claim:

1. A baby bottle holder comprising:

A) an anchor means for attachment to a support;

B) a flexible neck section attached at a proximal end thereof to said anchor means and having a distal end;

C) an outer cup which includes
(1) a bottom,
(2) a sidewall,
(3) means for attaching said outer cup to said distal end,
(4) air vents defined in said outer cup,
(5) a stop means on said sidewall, and
(6) a slide panel located on said sidewall;

D) an inner cup located inside said outer cup, said inner cup being sized to snugly and frictionally engage a baby bottle and including
(1) a bottom,
(2) a sidewall, and
(3) a top rim in sliding contact with said slide panel; and E) connection means for connecting said inner cup to said outer cup and including
(1) a spring mounting means on said inner cup and on said outer cup,
(2) a spring attached at one end thereof to said inner cup and at another end thereof to said outer cup, said spring biasing said inner cup towards said stop means, and
(3) means for adjusting said spring for adjusting the amount of bias applied to said inner cup.

2. The baby bottle holder defined in claim 1 wherein said slide panel includes a concave surface.

3. The baby bottle holder defined in claim 2 wherein said stop means includes a ledge located inside said outer cup and which extends radially inward of said outer cup.

4. The baby bottle holder defined in claim 2 wherein said stop means includes a rim on said outer cup with the rim on said inner cup extending radially outward from said inner cup a distance greater than the corresponding dimension of said outer cup whereby the rim on said inner cup abuts the rim on said outer cup.

5. The baby bottle holder defined in claim 2 further including a plurality of air vents defined in the bottom of said outer cup.

6. The baby bottle holder defined in claim 5 further including a plurality of air vents defined in the sidewall of said outer cup.

7. The baby bottle holder defined in claim 2 wherein said means for adjusting said spring includes a spring mounting bolt movably connected to the bottom of said outer cup, a threaded element connected to said spring mounting bolt and threadably mounted on the bottom of said outer cup to move with respect to the bottom of said outer cup to move said spring mounting bolt, said spring being connected to said spring mounting bolt to move therewith to change the amount of spring force being applied to the inner cup.

8. The baby bottle holder defined in claim 2 further including air holes defined through the bottom of said inner cup.

* * * * *